US008973305B2

(12) United States Patent
Zalesak

(10) Patent No.: US 8,973,305 B2
(45) Date of Patent: Mar. 10, 2015

(54) MITERED SHUTTER

(75) Inventor: Jon Zalesak, Clarissa, MN (US)

(73) Assignee: Springs Window Fashions, LLC, Middleton, WI (US)

( * ) Notice: Subject to any disclaimer, the term of this patent is extended or adjusted under 35 U.S.C. 154(b) by 464 days.

(21) Appl. No.: 12/396,781

(22) Filed: Mar. 3, 2009

(65) Prior Publication Data

US 2009/0223149 A1 Sep. 10, 2009

Related U.S. Application Data

(60) Provisional application No. 61/034,590, filed on Mar. 7, 2008.

(51) Int. Cl.
*E06B 7/08* (2006.01)
*E06B 7/09* (2006.01)

(52) U.S. Cl.
CPC ..... *E06B 7/09* (2013.01)
USPC ..... 49/74.1

(58) Field of Classification Search
USPC ..... 49/74.1, 402, 501
See application file for complete search history.

(56) References Cited

U.S. PATENT DOCUMENTS

| | | | | | |
|---|---|---|---|---|---|
| 122,805 | A * | 1/1872 | Brocck | 52/656.7 |
| 127,736 | A * | 6/1872 | Brock | 52/656.7 |
| 3,324,785 | A * | 6/1967 | Underdahl | 454/278 |
| 3,491,481 | A * | 1/1970 | Wunderlick | 49/74.1 |
| 3,908,528 | A * | 9/1975 | Bertin et al. | 454/314 |
| 4,766,806 | A * | 8/1988 | Tomiser et al. | 454/349 |
| 5,355,627 | A * | 10/1994 | Katz | 49/479.1 |
| 5,419,085 | A | 5/1995 | Imbur | |
| 5,490,353 | A * | 2/1996 | McLaughlin | 49/64 |
| 6,125,581 | A * | 10/2000 | Grossman | 49/74.1 |
| 6,240,599 | B1 | 6/2001 | Peer et al. | |
| 6,266,923 | B1 * | 7/2001 | Lee | 49/87.1 |
| 6,474,034 | B1 * | 11/2002 | Dronigi | 52/473 |
| 6,505,669 | B2 | 1/2003 | Lilie et al. | |
| 6,622,433 | B2 * | 9/2003 | Blachley | 49/506 |
| 6,675,534 | B2 | 1/2004 | Marocco | |
| 6,691,461 | B1 * | 2/2004 | Gitkin | 49/74.1 |
| 6,732,475 | B1 * | 5/2004 | Lee | 49/505 |
| 6,779,233 | B2 | 8/2004 | Migli | |
| 6,810,619 | B2 * | 11/2004 | Wilson | 49/74.1 |
| 6,810,620 | B1 * | 11/2004 | Anderson et al. | 49/74.1 |
| 6,854,211 | B1 | 2/2005 | Blachley | |
| 6,865,846 | B2 * | 3/2005 | Hsu | 49/74.1 |
| 6,901,701 | B2 * | 6/2005 | Lee | 49/82.1 |
| 7,055,231 | B1 | 6/2006 | Blachley | |
| 7,059,020 | B2 | 6/2006 | Sitter | |
| 7,082,719 | B2 * | 8/2006 | Regnery | 49/74.1 |
| 2004/0065015 | A1 * | 4/2004 | Nien | 49/67 |
| 2004/0226219 | A1 * | 11/2004 | Hsu | 49/74.1 |
| 2005/0102904 | A1 * | 5/2005 | Chuang | 49/74.1 |
| 2005/0204630 | A1 * | 9/2005 | Nien | 49/74.1 |

* cited by examiner

*Primary Examiner* — Jerry Redman
(74) *Attorney, Agent, or Firm* — Taylor IP, P.C.

(57) ABSTRACT

A shutter panel and an installation including a shutter panel in an architectural opening. The shutter panel has mitered corners without exposed end grain. The shutter panel is connected directly to structures defining the architectural opening.

5 Claims, 6 Drawing Sheets

MITERED SHUTTER

CROSS-REFERENCE TO RELATED APPLICATIONS

The present application claims the benefits of U.S. Provisional Application for Patent Ser. No. 61/034,590 filed Mar. 7, 2008.

FIELD OF THE INVENTION

The present invention relates generally to shutters for architectural openings and the manner in which such shutters are installed in the openings; and, more particularly, the invention pertains to the shutter structure, hinge, installation and fit.

BACKGROUND OF THE INVENTION

Interior shutters on windows, doors and other architectural openings are used for purposes that are both functional and aesthetic. A shutter can provide effective, adjustable light control and a pleasing appearance that enhances room decor.

A known shutter panel construction includes a pair of opposed stiles connected to a pair of opposed rails, the stiles and rails together defining an interior region in which adjustable louvers are mounted. The stiles are vertical components along opposite sides of the shutter panel, and the rails are horizontal components along the top and bottom of the shutter panel. It is known to butt-end join the horizontal rails to the interior edges of the vertical stiles. For a strong connection, mortise and tenon joints can be used. A disadvantage of known stile and rail constructions for window shutters is that a raw end surface of each vertical stile is exposed along the top edge surface and the bottom edge surface of the shutter panel. Frequently, the open end grain of the stiles exposed along the top and bottom edges of the shutter panel will not stain or otherwise surface finish in the same way as other areas of the stiles or rails. The exposed end grain can be unappealing aesthetically. Further, because cut ends or other machined surfaces are exposed in the completed shutter panel, it is necessary to stain and finish wood shutters or paint MDF shutters after the shutter panel is assembled. This often requires manually intensive processes rather than automated processes for finish application.

It is known to use a given number of louvers overlapping one another by fixed dimensions for a range of shutter sizes, and to adjust the height of a shutter panel by reducing the width of the rail pieces at the top and bottom of the shutter. With known panel frame construction, an unbalanced appearance can be a problem. Vertical frame members are not as wide as horizontal members, and the top and bottom members can vary in width from panel to panel.

To install a shutter, it is known further to mount one or more shutter panel in a mounting structure, such as a frame completely surrounding the shutter, or at least an edge mounting board. The panel or panels are connected to the mounting structure by hinges. The mounting structure is connected in a fixed position to the window jamb or other structure of the architectural opening in which the shutter is installed. The mounting structure is relatively immovably positioned, and the shutter panels secured thereto by hinges can be pivoted on the hinges toward and away from the architectural opening over which the shutter is positioned.

Procedures for mounting a shutter as described above have been used extensively and provide acceptable results in many situations; however, the design is not optimal for several reasons. For inexperienced individuals, measuring for the proper size of shutter can be difficult, allowing for tolerances of the separate independent structures, including the mounting frame and shutter panels. Assembling the complete shutter structure can be difficult, to maintain squareness of the frame, the panel and the panel within the frame. The completed assembly can be difficult to install correctly. Even when properly sized and installed, the mounting structure of a frame or board along at least the hinged side of the shutter effectively reduces the size of the window or other opening due to the fixed components secured to the opening. The fixed components block a portion of the opening, whether the shutter is opened or closed. Accordingly, the operation of a tilt in window may be compromised due to the mounting board or mounting frame obstructing window operation. Further, the known mounting arrangement can result in an installation incapable of opening through an angle greater than 90 degrees. For these reasons and more, the usefulness of known shutters is less than optimal.

Accordingly, there is a need for an improved shutter construction, to improve appearance and/or functionality while facilitating efficient manufacture, assembly and/or installation.

SUMMARY OF THE INVENTION

The present invention provides a shutter for windows, doors and other architectural openings having with mitered corners and variably overlapped louvers. The shutter is mounted directly by hinges, without the need for a separate mounting structure such as a mounting board or mounting frame. Extendable hinges can be used to move the shutter panel outwardly as the shutter is opened, to clear window trim surrounding the window opening.

In one aspect of one form thereof, the present invention provides a shutter panel with a top piece, a bottom piece and two side pieces connected to one another to define a space; a plurality of louvers disposed in the space, the louvers being rotatable between a closed position in which adjacent louvers overlap, and an open positioning in which spaces are provided between adjacent louvers. The top, bottom and side pieces are connected at mitered joints without exposed end grain.

In another aspect of another form thereof, the present invention provides a shutter installation for an architectural opening defined by a head structure above the architectural opening, a bottom structure below the architectural opening and jamb structures at the sides of the architectural opening. The shutter installation has a shutter panel having a top piece, a bottom piece and side pieces defining a panel opening there between and angularly adjustable louvers disposed in the panel opening between the top piece, the bottom piece and the side pieces. The top piece, the bottom piece and the side pieces having mitered surfaces connected one to another without exposed end grain. A hinge having releasable first and second components has one of the components connected to one of the side pieces and the other of the components connected to one of the jamb structures.

In still another aspect of still another form thereof, the present invention provides a shutter installation with an architectural opening having a head structure, a bottom structure and jamb structures defining the architectural opening, and a shutter panel covering at least a portion of the architectural opening, the shutter panel having a top piece, a bottom piece and side pieces defining a panel opening there between, and angularly adjustable louvers disposed in the panel opening between the top piece, the bottom piece and the side pieces. The top piece, the bottom piece and the side pieces have mitered end surfaces connected one to another without exposed end grain. A hinge has releasable first and second components, one of the components being connected to one of the side pieces and the other of the components being connected to one of the jamb structures.

An advantage of the present invention, in at least one form thereof, is providing a shutter for windows, doors and other architectural openings that is unique in appearance and aesthetically pleasing.

Another advantage of the present invention, in at least one form thereof, is providing a shutter that is uniform in appearance with top, bottom and side margin pieces of equal width, size and shape.

A further advantage of the present invention, in at least one form thereof, is providing a shutter having top, bottom and side pieces that are without exposed end grain or machined surfaces, to improve consistency of finishing characteristics and allow pre-finishing of component pieces.

Still another advantage of the present invention, in at least one form thereof, is providing a shutter for windows, doors and other architectural openings that includes appropriate light blocks so that cracks or openings are not visible from light infiltration above and below rotatable louvers of the shutter when the louvers are in a closed position.

Yet another advantage of the present invention, in at least one form thereof, is providing a shutter that does not permanently block a significant portion of a window, but instead can be opened to expose substantially the entire window.

Still another advantage of the present invention, in at least one form thereof, is providing a shutter for windows, doors and other architectural openings that is easy to install, and that can be mounted directly as an inset in the window or as an overlay of the window without a separate mounting frame.

Other features and advantages of the invention will become apparent to those skilled in the art upon review of the following detailed description, claims and drawings in which like numerals are used to designate like features.

Figure 1:
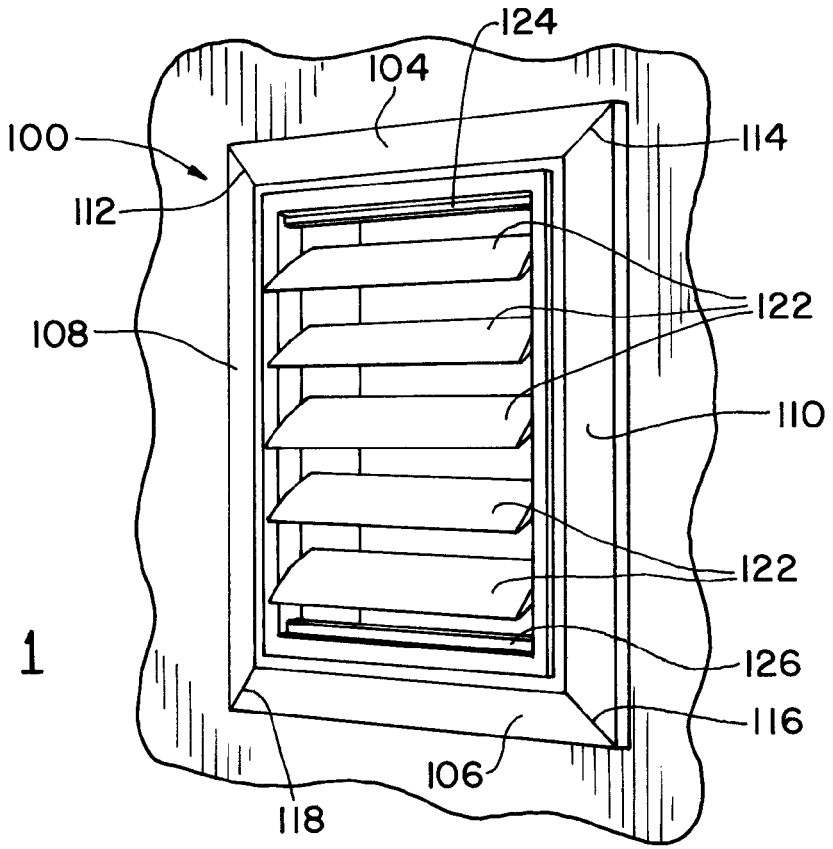
FIG. 1 is a perspective illustration of a single shutter installation in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
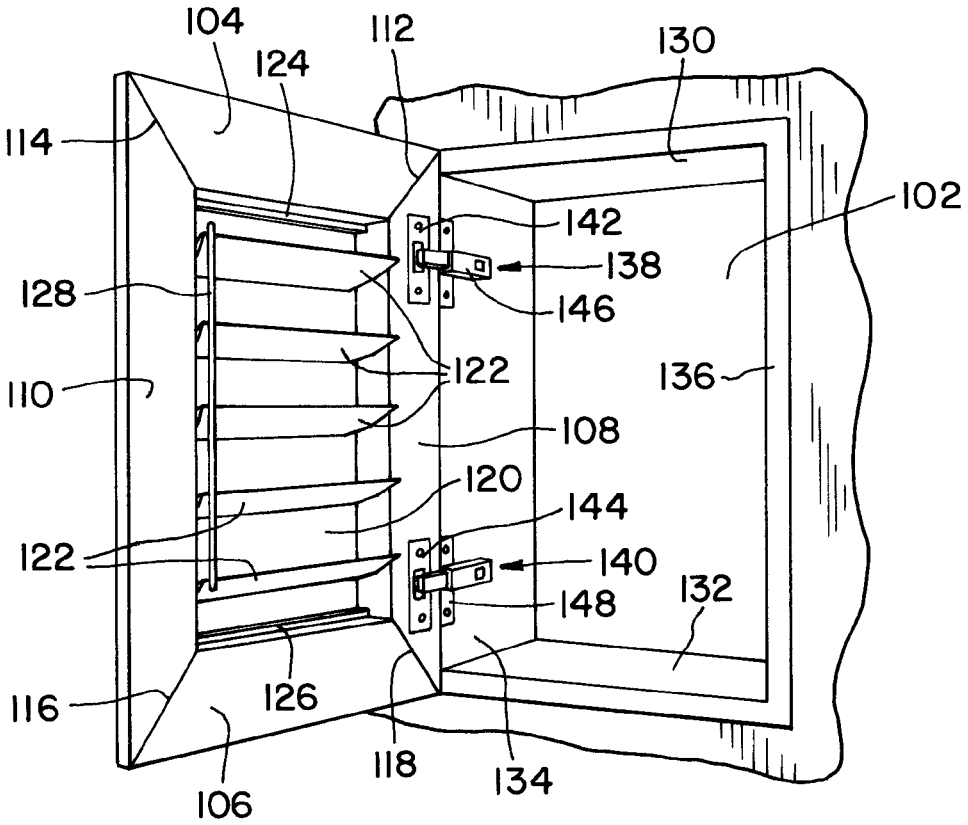
FIG. 2 is a perspective illustration of the single shutter illustrated in FIG. 1, but showing the shutter in an opened condition relative to a window on which is installed.

Referring now more specifically to the drawings and to FIGS. 1 and 2 in particular, a shutter panel 100 in accordance with the present invention is shown installed on an architectural opening 102. Shutter 100 includes opposed top and bottom pieces 104, 106 and opposed side pieces 108 and 110. Top piece 104, bottom pieces 106 and side pieces 108 and 110 are connected to each other at mitered corner joints 112, 114, 116 and 118. Thus, an outer frame defined by top and bottom pieces 104, 106 and side pieces 108, 110 defines a central open area 120. Closely adjacent, adjustable slats or louvers 122 are rotatably mounted in open area 120, rotatably secured in side pieces 108, 110. Top and bottom pieces 104, 106 include light block extensions 124, 126 respectively, which will be described in greater detail hereinafter. A tilt control rod 128 is connected to each louver 122 for adjusting the angular orientation of all louvers 122 simultaneously.

Architectural opening 102 includes a head 130 at the top of opening 102, a sill 132 at the bottom of window 102, and jambs 134, 136 on opposite sides of opening 102. Architectural opening 102 can be the opening of a window, door, access portal or other structure. Shutter panel 100 is mounted to jamb 134 by two hinges 138, 140. Hinges 138, 140 are separable, two-part hinges that are adjustable, each having a first component 142, 144 secured to shutter panel 100 and second component 146, 148 secured to jamb 134, respectively.

The two part hinges useful in the present invention make installation easy in that the assembled hinge on the shutter can be positioned where needed and the jamb marked so that screws can be used to secure the hinge in its proper place. For custom installations, hinge placement with respect to any desired shutter panel overlap of the opening or no overlap can be fixed relative to the opening dimension so that a jig or guide can be used for marking hinge locations on the architectural opening. In this way, it is not necessary to use the hinge itself for marking, and the shutter panel need not be held in position for determining hinge mount location. The hinge components can be separated, facilitating connection of the jamb component without the inconvenience of holding the shutter in place. After the jamb component of the hinge is connected to the jamb, the two hinge components are reconnected, and the hinge is adjusted to align the shutter as desired. Hinges such as that shown and others that can be used advantageously in preferred embodiments of the present invention provide multiple adjustments along three axes such that the shutter can be properly positioned and vertically aligned, particularly when two adjacent moveable panels are used. Different hardware packs, including different style hinges can be used to achieve desired shutter operation as an insert, a partial overlay or a full overlay and the desired arc through which the shutter can be opened. Articulating hinges that move the hinge pivot point outwardly can be used to provide full opening of shutter panels even when decorative trim is provided around the architectural opening and the shutter panel is positioned inwardly of the trim when closed. The method of installation is the same regardless of the installation option selected, be it as an overlay to or as an insert in the architectural opening. With standardization of hinge location and the use of separable two-part hinges, shutter panels of different patterns and appearance can be interchanged on an architectural opening. Accordingly, seasonal panels or other changes in color or appearance can be provided for a single opening and changed when desired simply by disconnecting one panel and connecting the second panel using the two-part hinges. Suitable two-part, multi-axis adjustable hinges are available from various furniture hardware suppliers, including but not limited to Arturo Salice S.p.A., Italy; Grass GmbH Furniture Hardware, Austria; and Julius Blum GmbH, also of Austria.

Figure 3:
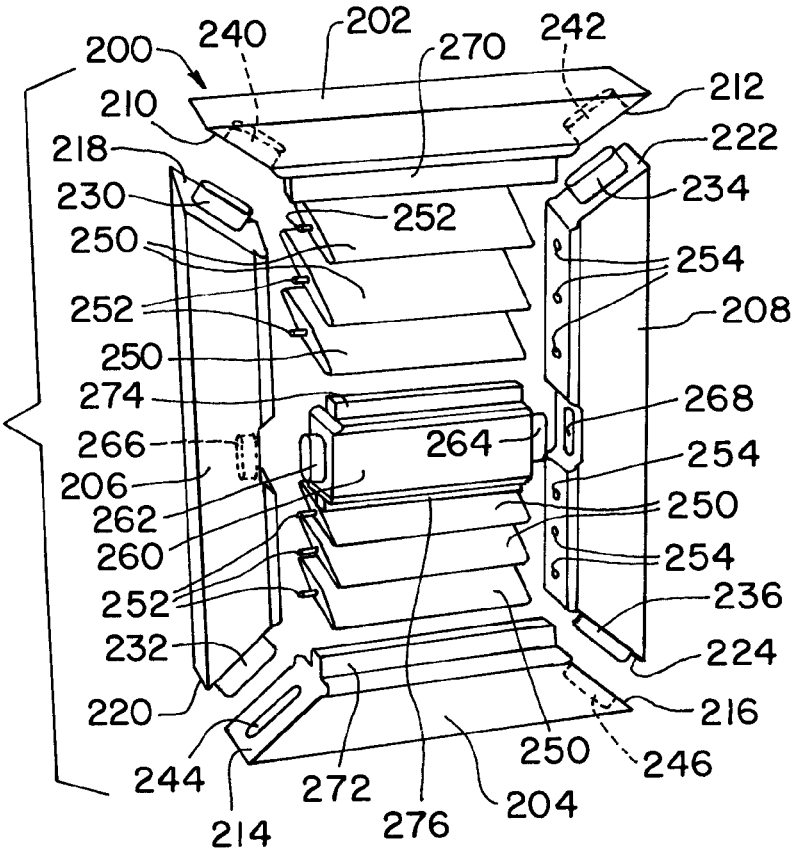
FIG. 3 is an exploded view of a shutter in accordance with the present invention.

FIG. 3 is an exploded view of a shutter in accordance with the present invention. Shutter panel 200 includes top and bottom pieces 202, 204 and side pieces 206, 208 connected by mitered joint surfaces 210, 212, 214, 216, 218, 220, 222 and 224 at the ends thereof, which can be shaped so as to include mortise and tenon connections for added strength. As illustrated, the angular end surfaces 218, 220 and 222, 224 of vertical side pieces 206, 208, respectively, form tenons 230, 232, 234, 236 that are received in pockets formed in the angular end surfaces 210, 212, 214, 216 of top and bottom pieces 202, 204. Only one such pocket 244 formed in mitered joint surface 214 is visible in FIG. 4; however, the locations of pockets 240, 242 and 246, which are not visible in the angular perspective of FIG. 3, are shown in dashed lines.

Louvers 250 are connected by pins 252 at each end of the louver to vertical side pieces 206, 208; the pins 252 being received in holes 254 whereby louvers 250 can rotate. Some, but not all pins 252 and holes 254 have been shown and designated with reference numerals in FIG. 3. As those skilled in the art will readily understand further that one or more set of pins 252 for one or more louver 250 may be replaced by a tension rod, torque louver or other structure extending through the louver and anchored in side pieces 206, 208 to draw side pieces 206, 208 toward one another and inhibit bowing or other deformation of the shutter assembly.

A divider rail 260 having tenons 262, 264 at the ends thereof is positioned between upper and lower groups of louvers 250. Tenons 262, 264 are received in pockets 266, 268 formed in the inside surfaces of vertical pieces 206, 208. Pocket 266 is shown for side piece 206, and the location of pocket 268 in side piece 208 is shown in dashed lines.

Light blocks 270, 272, 274 and 276 are provided on the inner edges of top piece 202 and bottom piece 204, and on the top and bottom edges of divider rail 260, respectively. Light blocks 270, 272, 274 and 276 are elongated, continuous, inwardly projecting protrusions that extend from one side piece 206, 208 to the other side piece 206, 208. Each light blocks 270, 272, 274 and 276 is overlapped by an edge of the louver 250 immediately adjacent thereto, when the louver is in a closed position. Accordingly, in closed positions for the louvers of the shutter panel, with each light block 270, 272, 274 and 276 overlapped by an immediately adjacent louver 250, light infiltration is effectively blocked, minimizing light leakage around the edges of the louvers.

It should be understood that the present invention is capable of many variations and changes. A shutter of the present invention can be provided in various sizes and shapes, and with different appearances. For example, and not for limitation, a shutter of the present invention can be provided with or without a divider rail as shown in FIG. 3, or can be provided with multiple divider rails if desired. More or fewer louvers can be provided, with different overlap dimensions for adjacent louvers. The louvers can be provided in a different dimensions and contours, to achieve the desired function and appearance. The top, bottom and a side pieces can be provided in simple shapes as shown, or can be provided in various ornate contours commonly used for moldings and trim. Shutter panels can be provided individually over an opening, or multiple shutter panels can be used separately hinged to the architectural opening. Further, two or more shutter panels can be connected by hinges one to another to provide a bi-fold or overlapping opening arrangement. Still further variations can be incorporated into shutters of the present invention. The simple, basic structures shown and described herein should not be interpreted as limitations of the invention in any way.

FIGS. 4-16 illustrate some variations for installations of shutters in accordance with the present invention. The variations shown and described are exemplary and should not be considered exhaustive of the installation variations that can be used.

Figure 4:
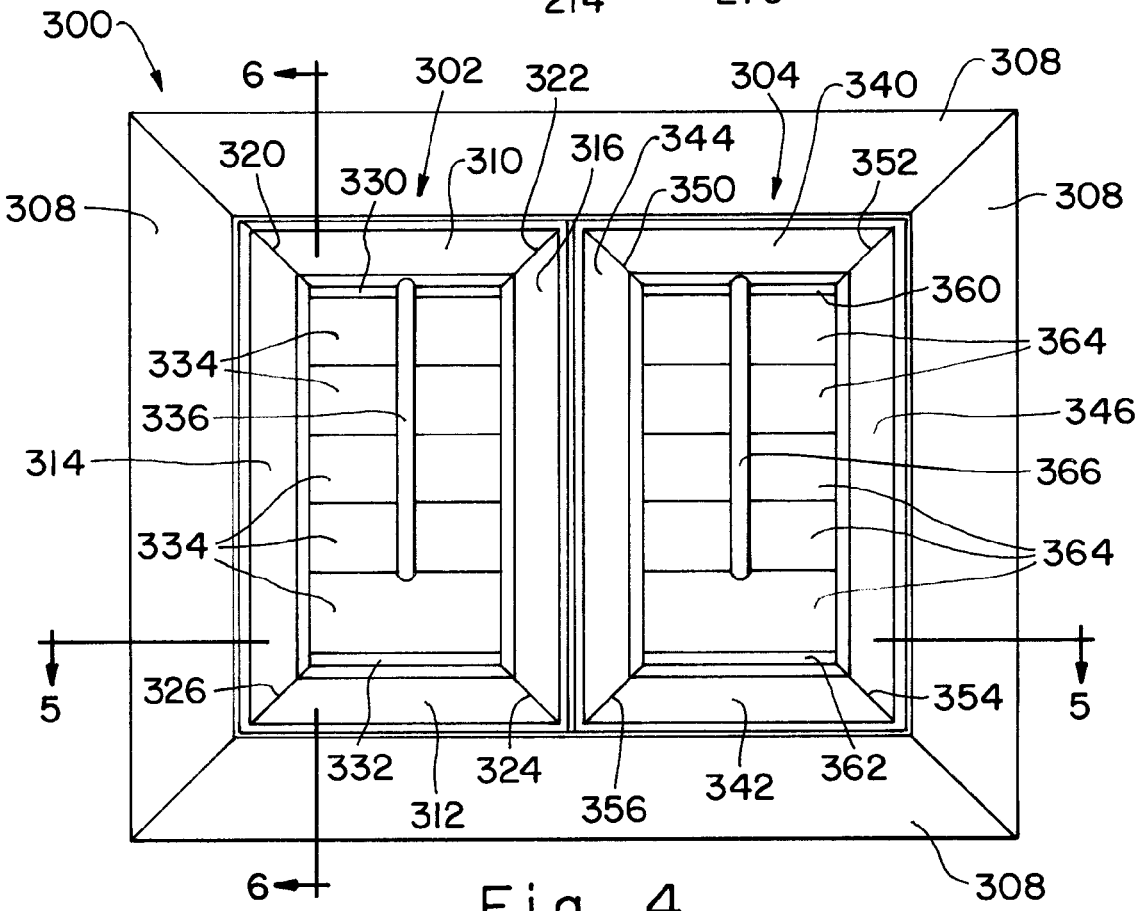
FIG. 4 is an elevational view of a shutter installation in accordance with the present invention, illustrating first and second shutter panels installed on a window having decorative trim.
Figure 5:
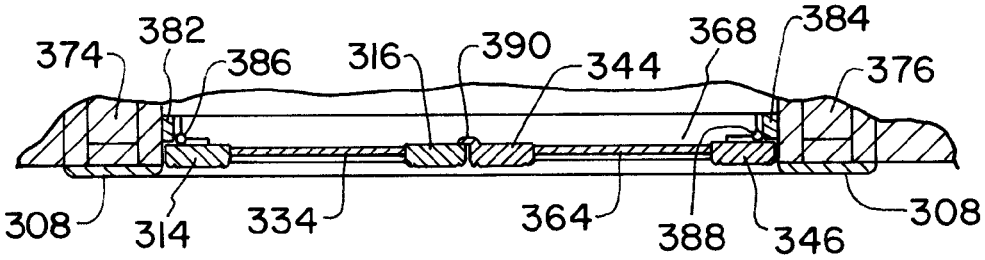
FIG. 5 is a horizontal cross-sectional view of the shutter installation shown in FIG. 4, taken along line 5-5 of FIG. 4.
Figure 6:
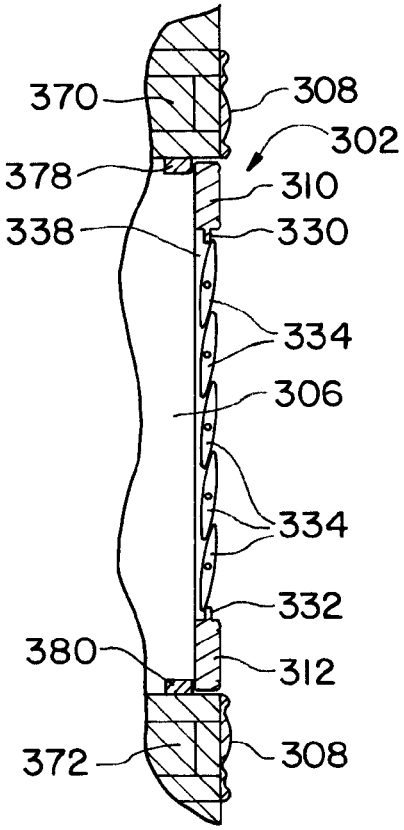
FIG. 6 is a vertical cross-sectional view of the shutter installation shown in FIG. 4, taken along line 6-6 of FIG. 4.

FIGS. 4-6 illustrate a shutter installation 300 having first and second shutter panels 302, 304 installed in a window or opening 306. Window/opening 306 is surrounded by trim or molding pieces 308 on all four sides. A window sill is not provided. Panel 302 includes a top piece 310 a bottom piece 312 and side pieces 314, 316 connected at miter joints 320, 322, 324, 326. Light blocks 330, 332 are provided on top piece 310 and bottom piece 312, respectively. A plurality of louvers 334 connected by a tilt control rod 336 are provided within an opening 338 defined by top piece 310, bottom piece 312 and side pieces 314, 316. Panel 304 includes a top piece 340, a bottom piece 342 and side pieces 344, 346 connected at miter joints 350, 352, 354, 356. Light blocks 360, 362 are provided on top piece 340 and bottom piece 342. A plurality of louvers 364 connected by a tilt rod 366 are provided within an opening 368 defined by top piece 340, bottom piece 342 and side pieces 344, 346.

Window opening 306 is defined by a head structure 370, a bottom structure 372 and side jamb structures 374, 376. A trim or molding piece 308 is connected to each of head structure 370, bottom structure 372 and jamb structures 374, 376. In the exemplary installation shown, shutter panels 302, 304 are installed within the space defined between head structure 370, bottom structure 372 and jamb structures 374, 376. Accordingly, head the structure 370 extends over shutter panels 302, 304; bottom structure 372 extends beneath shutter panels 302, 304 and jamb structures 374, 376 extend alongside shutter panels 302, 304. Light blocks 378, 380, 382, 384 are provided on head structure 370, bottom structure 372 and jamb structures 374, 376, respectively. Light blocks 378, 380, 382, 384 block light infiltration along the spaces defined between shutter panels 302, 304 and window opening 306. A plurality of hinges connect each shutter panel 302, 304 to window opening 306, one such hinge 386 being shown for shutter panel 302 and another such hinge 388 being shown for shutter panel 304. Side piece 344 is provided with an astragal 390 to overlap with side piece 316 to block light infiltration between panels 302, 304.

In the exemplary installation illustrated in FIGS. 4-6, shutter panels 302, 304 are mounted within the architectural opening 306, a window opening as shown. As can be seen from the cross-sectional views, shutter panels 302, 304 do not project outwardly beyond trim pieces 308. Articulating hinges can be used to move shutter panels 302, 304 outwardly of the window opening 306, to clear trim pieces 308 provided around the opening and to provide substantially complete exposure of window opening 306.

Figure 9:
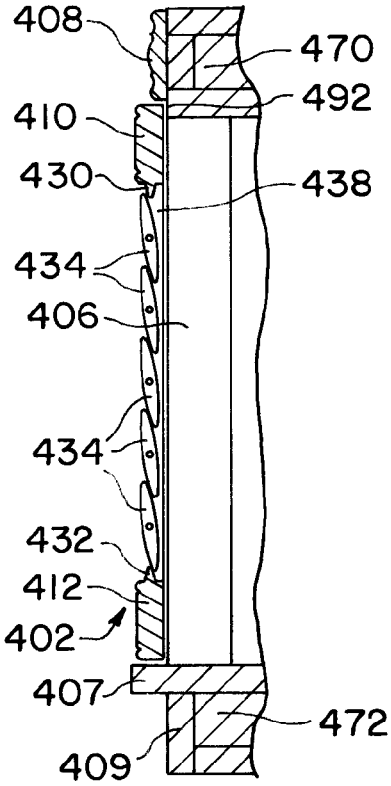
FIG. 9 is a vertical cross-sectional view of the shutter installation shown in FIG. 7, taken along line 9-9 of FIG. 7.
Figure 8:
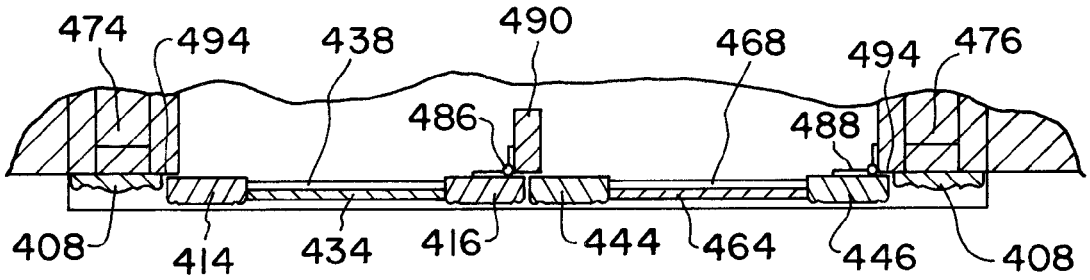
FIG. 8 is a horizontal cross-sectional view of the shutter installation shown in FIG. 7, taken along line 8-8 of FIG. 7.
Figure 7:
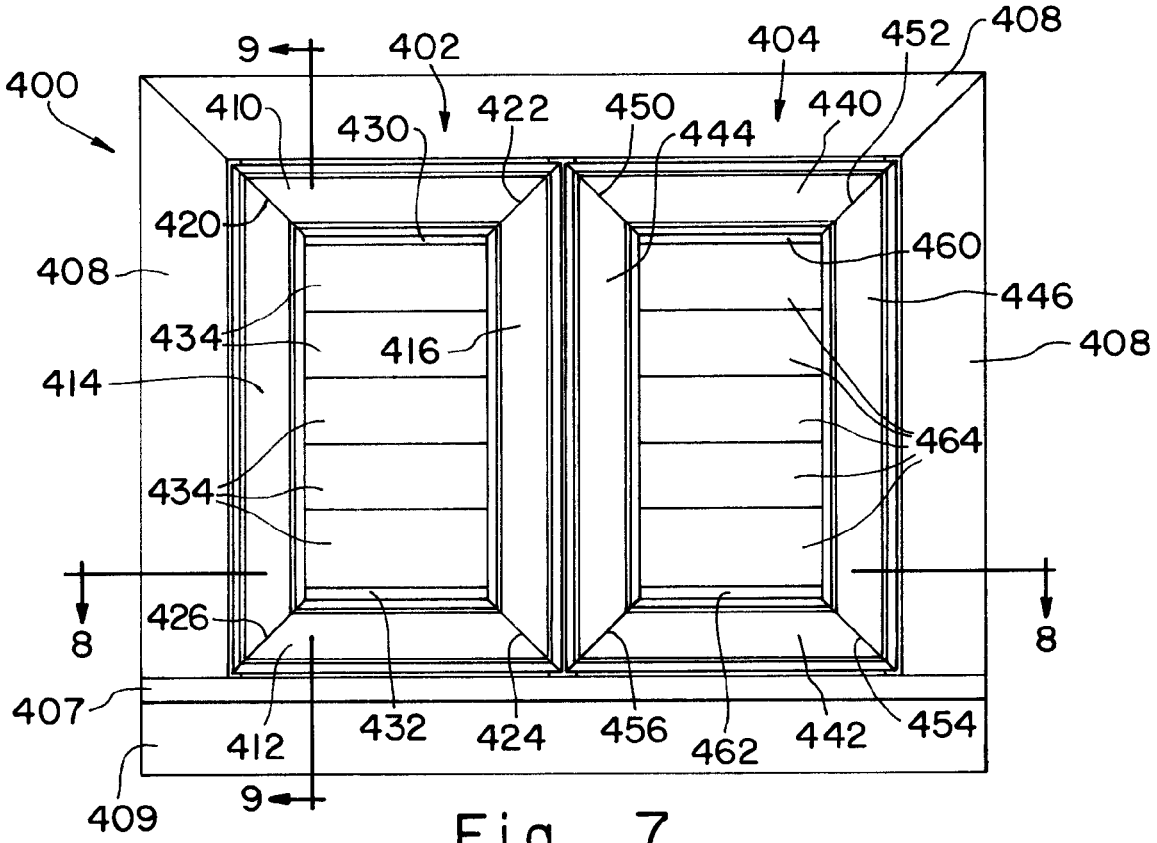
FIG. 7 is an elevational view of a shutter installation in accordance with the present invention, illustrating first and second panels installed on a window having decorative trim and a sill.

FIGS. 7-9 illustrate a shutter installation 400 similar to installation 300 shown in FIGS. 4-6. Shutter panels 402, 404 are installed in a window opening 406; however, a sill 407 extends inwardly at the bottom of window opening 406, and trim or molding pieces 408 are provided only on three sides of opening 406. An apron trim piece 409 is provided beneath sill 407.

Panel 402 includes a top piece 410 a bottom piece 412 and side pieces 414, 416 connected at miter joints 420, 422, 424, 426. Light blocks 430, 432 are provided on top piece 410 and bottom piece 412, respectively. A plurality of louvers 434 are provided within an opening 438 defined by top piece 410, bottom piece 412 and side pieces 414, 416.

Panel 404 includes a top piece 440, a bottom piece 442 and side pieces 444, 446 connected at miter joints 450, 452, 454, 456. Light blocks 460, 462 are provided on top piece 450 and bottom piece 452. A plurality of louvers 464 are provided within an opening 468 defined by top piece 440, bottom piece 442 and side pieces 444, 446.

Window opening 406 is defined by a head structure 470, a bottom or sill structure 472 and side jamb structures 474, 476. A trim or molding piece 408 is connected to each of head structure 470 and jamb structures 474, 476. A plurality of hinges connect each shutter panel 402, 404 to window opening 406, one such hinge 486 being shown for shutter panel 402 and another such hinge 488 being shown for shutter panel 404. In this embodiment, a center post 490 is connected to head structure 470 and sill structure 472. Side piece 416 of shutter panel 402 and side piece 444 of shutter panel 404 overlap center post 490. Center post 490 blocks light infiltration between shutter panels 402, 404. One or the other of shutter panels 402, 404 can be, but need not necessarily be, connected by hinges to center post 490. Alternatively, each of shutter panels 402, 404 can be connected by hinges to a jamb structure 474, 476.

As shown most clearly in the cross-sectional views of FIGS. 8 & 9, shutter panels 402, 404 slightly overlap head structure 470 and jamb structures 474, 476. A well used finish carpentry technique is to install trim pieces 408 recessed slightly from the inner edges of underlying structures such as head structure 470 and jamb structures 474, 476. Accordingly, a so-called "reveal" or exposed surface of the underlying structure is provided. A reveal 492 is shown for a head structure 470 and reveals 494 and 496 are shown for jamb structures 474, 476 respectively. Top pieces 410, 440 of shutter panels 402, 404 overlap reveal 492, and side pieces 414 and 446 of shutter panels 402, 404 overlap jamb structure reveals 494, 496 respectively. Light infiltration is restricted by the overlapping installation of shutter panels 402, 404. To minimize light infiltration beneath shutter panels 400, 402 a light block similar to light block 380 can be used on top of sill 407, overlapped by bottom pieces 412, 442.

It should be understood that the overlapping installation within the reveals of the trim finish, as shown and described for shutter installation 400, can be used in other types of window structures as well. For example, while shown in an installation having a sill 407, a similar overlapping installation could be used in an installation for a window not having a sill, such as window opening 306 described for installation 300.

Figure 10:
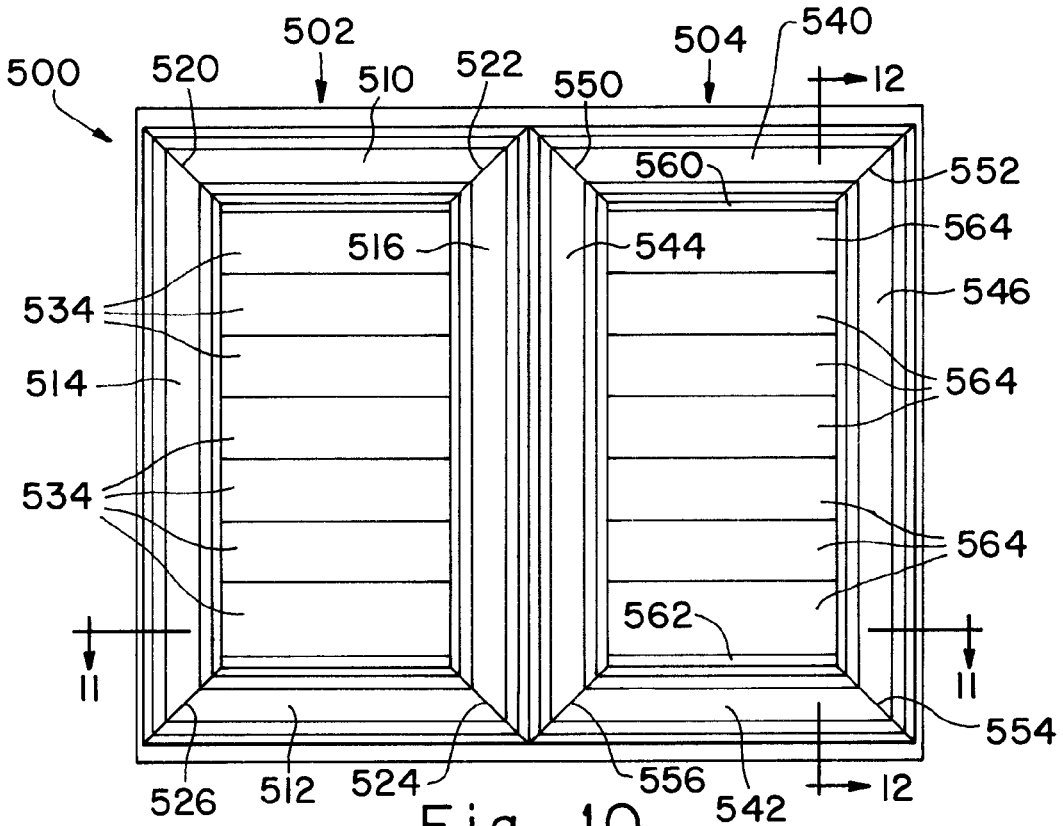
FIG. 10 is an elevational view of a shutter installation in accordance with the present invention, illustrating first and second shutter panels installed on a window having no trim.
Figure 11:
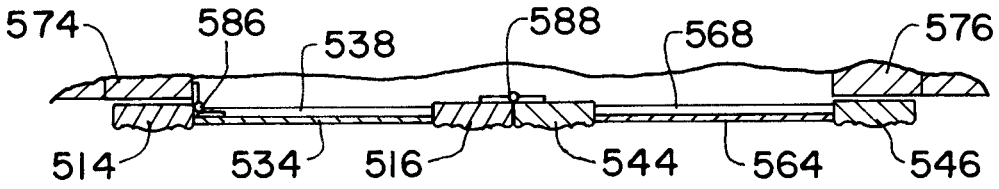
FIG. 11 is a horizontal cross-sectional view of the shutter installation shown in FIG. 10, taken along line 11-11 of FIG. 10.
Figure 12:
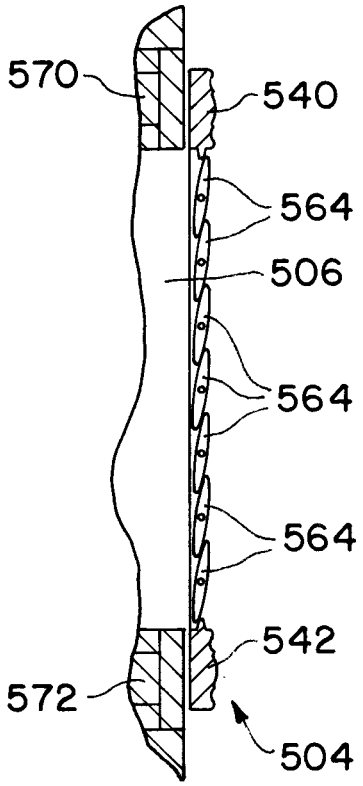
FIG. 12 is a vertical cross-sectional view of the shutter installation shown in FIG. 10, taken along line 12-12 of FIG. 10.

FIGS. 10-12 illustrate another embodiment for an installation 500 in accordance with the present invention in which shutter panels 502, 504 are installed on an architectural opening 506 having no trim or molding pieces there around. In exemplary installation 500, shutter panels 502, 504 are mounted on the surface of architectural opening 506, and not within architectural opening 506. Shutter panel 502 includes a top piece 510 a bottom piece 512 and side pieces 514, 516 connected at miter joints 520, 522, 524, 526. Light blocks 530, 532 are provided on top piece 510 and bottom piece 512. A plurality of louvers 534 are provided in an opening 538 defined by top piece 510, bottom piece 512 and side pieces 514, 516. Panel 504 includes a top piece 540, a bottom piece 542 and side pieces 544, 546 connected at miter joints 550, 552, 554, 556. Light blocks 560, 562 are provided on top piece 550 and bottom piece 552. A plurality of louvers 564 are provided within an opening 568 defined by top piece 540, bottom piece 542 and side pieces 544, 546.

Window opening 506 is defined by a head structure 570, a bottom structure 572 and side jamb structures 574, 576. In the exemplary installation shown, shutter panels 502, 504 are installed on the surface of window opening 506, not within the space defined between head structure 570, bottom structure 572 and jamb structures 574, 576. Shutter panels 502, 504 overlap head structure 570, bottom structure 572 and jamb structures 574, 576. Accordingly, like blocks within the window opening are not required. Hinges connect shutter panel 502 to window opening 506, one such hinge 586 being shown for shutter panel 502. Another hinge or hinges 588 connect shutter panel 504 to shutter panel 502 in a bi-fold arrangement. Accordingly, as illustrated in the exemplary illustration, both shutter panels 502, 504 are opened to the left of the window opening 506.

Figure 14:
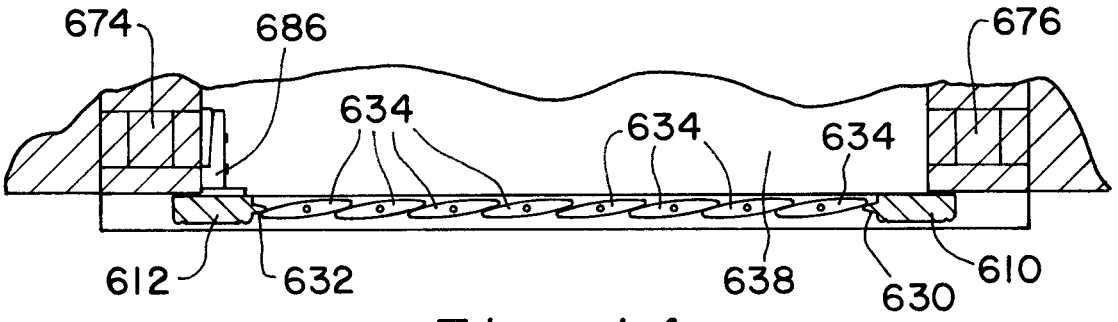
FIG. 14 is a horizontal cross-sectional view of the shutter installation shown in FIG. 13, taken along line 14-14 of FIG. 13.
Figure 13:
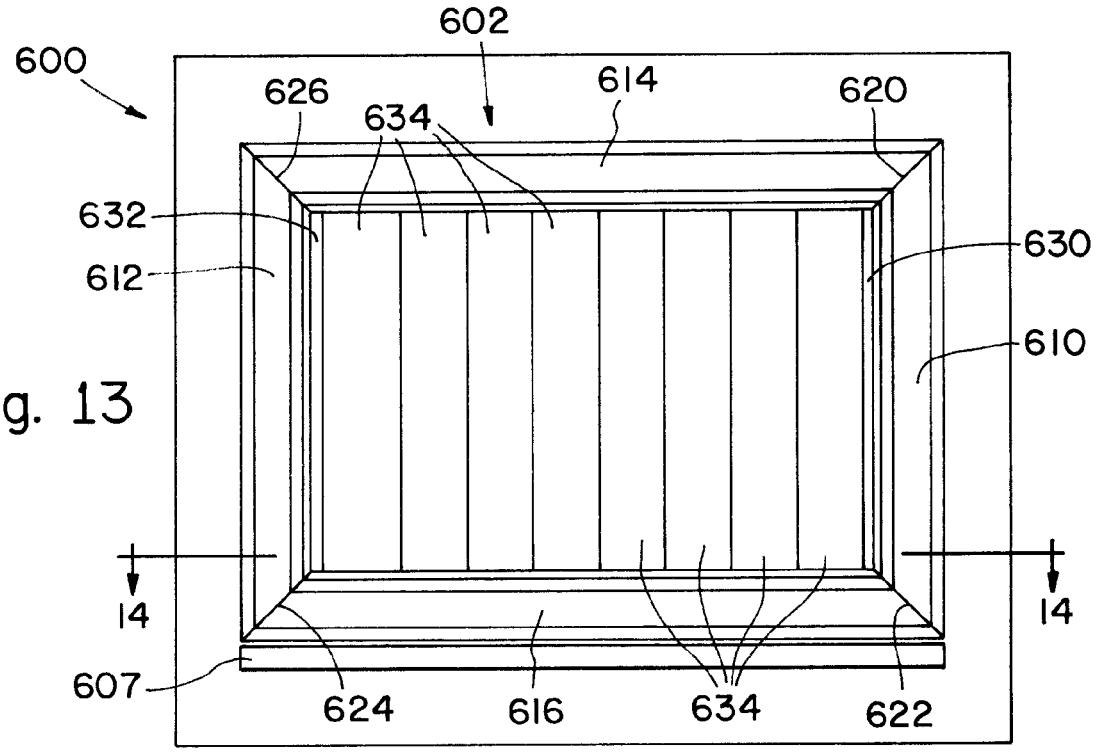
FIG. 13 is an elevational view of yet another shutter installation in accordance with the present invention, illustrating shutter panels installed on a window having a sill and no trim.

FIGS. 13 and 14 illustrate yet another shutter panel installation 600 in accordance with the present invention. One feature of the invention is that the pieces defining the top, bottom and sides of the shutter panel and the opening thereof in which louvers are installed are similarly configured. Accordingly, unlike known structures in which butt joints are formed leaving raw edges of the stiles at the top and bottom edges of the shutter panel, the present mitered corners can be installed in any orientation. A shutter having horizontal louvers can be installed sideways, with louvers vertically positioned. Installation 600 includes a panel 602 installed in a trim-less window opening 606 having a sill 607. Panel 602 has a top-now-side piece 610, a bottom-now-side piece 612, a side-now-top piece 614 and a side-now-bottom piece 616 connected at miter joints 620, 622, 624, 626. Light blocks 630, 632 are provided. A plurality of louvers 634 are provided in an opening 638. Unlike previous installations described here in, louvers 634 are vertically arranged rather than horizontally arranged. Window 606 includes jamb structures 674, 676 at the sides thereof. Shutter panel 602 is connected to jamb structure 674 by an articulating hinge 686. Only a single panel is shown for installation 600; however it should be understood that two panels separately hinged or hinged in a bi-fold arrangement as described in previous embodiments also can be used.

Figure 16:
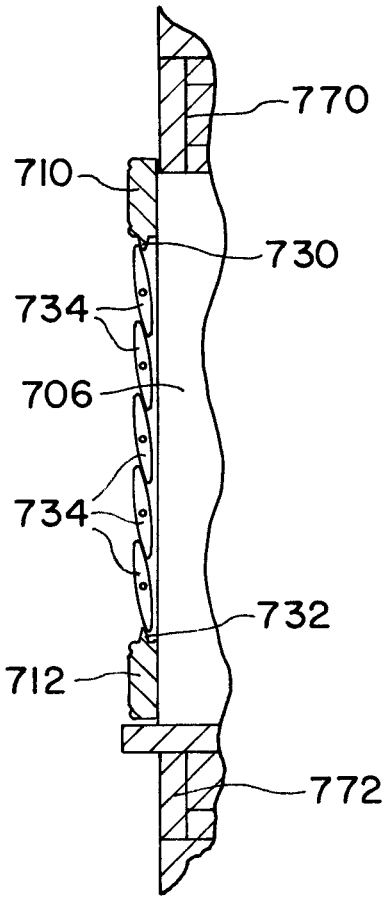
FIG. 16 is a vertical cross-sectional view of the shutter installation shown in FIG. 15, taken along line 16-16 of FIG. 15.
Figure 15:
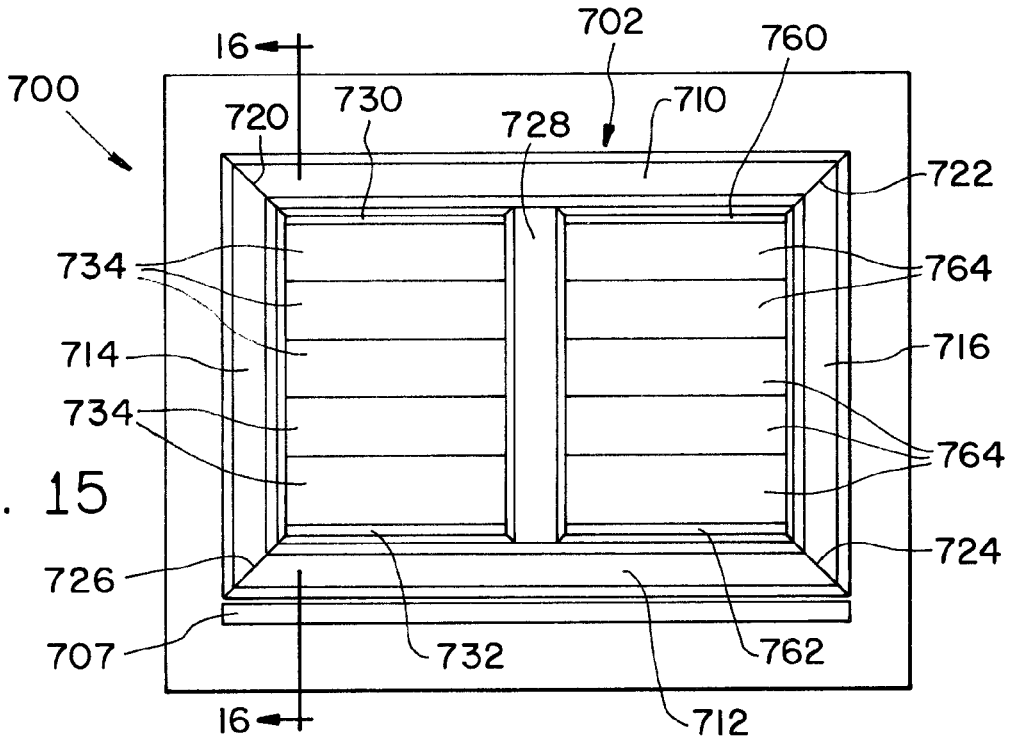
FIG. 15 is an elevational view of still another shutter installation in accordance with the present invention, illustrating shutter panels installed on a window having a sill and no trim.

FIGS. 15 and 16 illustrate yet another shutter installation 700 in accordance with the present invention. Installation 700 includes a panel 702 installed in a trim-less window opening 706 having a sill 707. Panel 702 has a top piece 710, a bottom piece 712 and side pieces 714 and 716 connected at miter joints 720, 722, 724, 726. A vertical divider stile 728 is connected between top piece 710 and bottom piece 712. Light blocks 730, 732 are provided on top piece 710 and bottom piece 712, respectively, between side piece 714 and divider stile 728. A first plurality of louvers 734 are provided in an opening defined by top piece 710, bottom piece 712, side piece 714 and divider stile 728. Light blocks 760, 762 are provided on top piece 710 and bottom piece 712, respectively, between side piece 7164 and divider stile 728. A second plurality of louvers 764 are provided in an opening defined by top piece 710, bottom piece 712, side piece 716 and divider stile 728. Window 706 includes jamb structures 774, 776 at the sides thereof. Shutter panel 702 is connected to jamb structure 774 or jamb structure 776 by a hinge (not shown).

The shutters described herein and still other variations of the invention can be manufactured by automated equipment in custom sizes, including infinite louver spacing and arrangement while maintaining advantages of mass-production. Through algorithmic control of the manufacturing and assembly processes, the positions and spatial relationships of parts within the assembly can be adjusted and customized for customized overall assemblies. For example, divider rail or divider stile positioning can be customized to a customer's specifications, and need not be centrally positioned as described herein. The numbers of louvers used and the overlap dimension of adjacent louvers can be changed to accommodate different sizes required for shutter panels. While an embodiment has been shown with an integral astragal formation, for further standardization of parts, and the minimization of different parts of the shutters and add-on astragal can be used, either as a structural insert or as a bonded attachment with adhesive. All of outer pieces of the shutter panels, including the top piece, the bottom piece and both side pieces can then be of the same design.

Cut ends of the shutter panel outer components are incorporated in the joint formations, and not exposed. Accordingly, long pieces can be pre-finished in automated processes and subsequently cut to required lengths. This reduces manually intensive hand operated processes often used for prior art constructions. Shutters of the present invention can be shipped ready for installation, without further assembly required.

It should be understood also that the concepts disclosed herein are not limited in scope to rectangular window shutters, but can have other applications as well. For example and not limitation, the invention can be applied to arched shutters and shutters for other irregularly shaped applications, French-style doors and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A shutter panel connected to a jamb structure defining the sides of a window opening, said shutter panel comprising:
   - a top piece, a bottom piece and two side pieces connected to one another to define a space, each of said top, bottom and side pieces having a mitered angular end surface at each end thereof;
   - a plurality of rotatable louvers disposed in said space, said louvers being rotatable between a closed position in which adjacent louvers overlap, and an open position in which spaces are provided between adjacent louvers;
   - said louvers being pivotally connected directly to said two side pieces by individual pins at each end of each louver, each said pin directly connected at one end to a louver and at an opposite end to one of said two side pieces;
   - said top, bottom and side pieces connected at mitered joints without exposed end grain; and
   - at least two two-part hinges each have a first component directly connected to a same one of said two side pieces of said shutter panel and a second component directly connected to an inside surface of the jamb structure defining the sides of the window opening.

2. The shutter panel of claim 1, said top piece and said bottom piece each having a light block extension overlapped by louvers adjacent thereto in said closed position.

3. The shutter panel of claim 1, said mitered joints including mortise and tenon joints.

4. The shutter panel of claim 1, including a divider rail between separate groups of horizontal louvers.

5. The shutter panel of claim 4, said divider rail including light block extensions on opposite edges thereof, and louvers adjacent said divider rail overlapping side light block extensions when in said closed position.

* * * * *